US006336711B1

(12) United States Patent
Ahn

(10) Patent No.: US 6,336,711 B1
(45) Date of Patent: Jan. 8, 2002

(54) SPRAYING DEVICE OF AN INK JET PRINTER

(75) Inventor: Byung-Sun Ahn, Suwon-si (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/210,958

(22) Filed: Dec. 15, 1998

(30) Foreign Application Priority Data

Dec. 19, 1997 (KR) ..... 97-70917

(51) Int. Cl.[7] ..... B41J 2/04
(52) U.S. Cl. ..... 347/54
(58) Field of Search ..... 347/54, 68, 69, 347/70, 71, 72, 50, 40; 399/261; 361/700; 29/890.1; 310/328–330

(56) References Cited

U.S. PATENT DOCUMENTS 4,332,707 A 6/1982 Roberts et al.
5,594,044 A 1/1997 Yang
5,754,194 A * 5/1998 Endo et al.
5,772,741 A 6/1998 Spinelli
5,821,962 A 10/1998 Kudo et al.
5,825,391 A 10/1998 Yang

FOREIGN PATENT DOCUMENTS

JP 4-163049 * 6/1992 ..... 347/54

* cited by examiner

*Primary Examiner*—Raquel Yvette Gordon
(74) *Attorney, Agent, or Firm*—Robert E. Bushnell, Esq.

(57) ABSTRACT

A spray device of an ink jet printer comprising: a substrate; a heating means formed on a surface of the substrate; plural anodes offering electric energy to the heating means; an insulation material formed on the upper end of the heating means; a liquid actuator as fluid stored in a space produced by the insulation material and responding to the thermal energy offered from said heating means, and using Heptane ($C_7H_{16}$) or Perfluoroheptane ($C_7F_{16}$) having a settled speed of boiling and condensing in a short time and preventing corrosion of the heating means; a membrane causing a volume change according to said fluid; an ink supply path offering ink to the top end of the membrane; and an ink spray opening formed in order to spray ink according to a motion of said membrane.

23 Claims, 1 Drawing Sheet

SPRAYING DEVICE OF AN INK JET PRINTER

CLAIM OF PRIORITY

This application makes reference to, incorporates the same herein, and claims all benefits accruing under 35 U.S.C. § 119 from my application entitled Jetting Apparatus in Inkjet Printer filed with the Korean Industrial Property Office on Dec. 19, 1997 and there duly assigned Ser. No. P97-70917 by that Office.

BACKGROUND OF THE INVENTION

1. Field of the Invention

The present invention relates to the field of incremental printing, in particular to ink jet printing devices, and more particularly to an ink jet spraying device using a liquid actuator to drive a membrane.

2. Discussion of Related Art

There are several methods used in spraying devices of ink jet printers. First of all, there is a method spraying bubbles formed in an ink chamber using the heat incurred when electric energy is delivered to a resistant element. In this method, however, the ingredients of ink undergo thermal changes as the bubbles formed by high heat. Also, the internal life expectancy of the device is reduced due to an impact wave by the bubbles. These factors can noticeably reduce the quality of the printing to an undesirable level.

Another method is to use a membrane between the heating unit and the ink. In an earlier example of such a device, a heating unit performing heating is formed on a surface of a substrate layer by electric energy. Electrodes of different polarity which input power offered from a power unit and offer the electric energy to the heating unit are formed on the surfaces of the substrate and the heating unit. A protection layer is formed on surfaces of the electrodes and the heating unit. The insulation layer is formed with a regular interval on some locations pertinent to the surface of electrodes on protection layer. And a membrane layer is formed on a surface of the insulation layer. The spaces formed by the protection layer, the electrodes, the insulation layer and the membrane layer are called the heating chamber. Ink is stored in an ink chamber formed by an ink chamber barrier on a surface of the membrane layer. And a nozzle plate having an opening is formed on a surface of ink chamber barrier. And a liquid actuator which is a liquid with a low boiling point is stored in the heating chamber.

Thus, in this device, the heating chamber configuration has a protection layer formed on the heating unit. The energy transmitted to a liquid actuator within heating chamber is transmitted in inverse proportion to the thickness of protection layer. Accordingly, it is necessary to drive the device with high energy and low frequency, with a result of high power consumption and low printing speed.

A membrane-containing spraying unit generally uses a liquid actuator which is different from ink. Examples from the contemporary art of inkjet inks for the first mentioned method of inkjet printing are seen, for example, in the following U.S. Patents. U.S. Pat. No. 5,772,741, to Spinelli, entitled Aqueous Ink Jet Ink Compositions, discusses an inkjet ink containing a non-aqueous carrier, which can be one of many organic solvents, among which heptane is mentioned. U.S. Pat. No. 5,594,044, to Yang, entitled Ink Jet Ink Which Is Rub Resistant To Alcohol, and U.S. Pat. No. 5,825,391, also to Yang, entitled Method For Forming Images Using A Jet Ink Which Is Rub Resistant To Alcohol, discuss an inkjet ink containing one of many organic solvents, among which heptane is mentioned. In these three patents, however, the compositions are designed to be used as the ink in an inkjet printer, and not as a liquid actuator in a membrane-containing spraying device.

U.S. Pat. No. 5,821,962, to Kudo et al., entitled Liquid Ejection Apparatus And Method, discusses a bubble jet device having a movable member driven by the formation of a bubble in a fluid, with the movable member ejecting the ink. The movable member does not, however, form a membrane completely enclosing the heating chamber, as in the membrane-containing device described above. The patent discusses omitting a protection layer on the resistance layer when certain materials are used for the resistance layer and the liquid; specifically, iridium-tantalumaluminum alloy is mentioned for the resistance layer but no example is given for the liquid. The patent discusses various liquids which may be used as bubble generation liquids, including n-heptane. As noted, this patent discusses a device of a design which is different from the membrane-containing device discussed above in that the movable member does not enclose the heating chamber.

Based on my observation of the art, then, I have found that what is needed is an ink-jet print head which does not suffer from the ink and device deterioration problems of the ink jet spraying device not containing a membrane, and which does not suffer from the high power consumption and slower print speed of the earlier spraying device which does contain a membrane.

SUMMARY OF THE INVENTION

It is therefore an object of the present invention to provide an improved spraying device for an inkjet printer.

It is a further object of the present invention to provide a spraying device for an inkjet printer having a high internal life expectancy.

It is a yet further object of the present invention to provide a spraying device for an inkjet printer having high print quality.

Is a still further object of the present invention to provide a spraying device with low power consumption.

It is a still yet further object of the present invention to provide a spraying device which allows high-speed printing.

It is another object of the present invention to provide a spraying device which is less expensive to produce.

The present invention provides a spraying device which does not show any chemical reaction even though the liquid actuator within the heating chamber is adhered closely to the heating device. The present invention also provides a spraying device which brings about vapor pressure in a short time. To achieve these objects, one aspect of the present invention is to use an isomer of heptane ($C_7H_{16}$), or perfluoroheptane ($C_7F_{16}$), in particular n-heptane or n-perfluoroheptane, as a liquid actuator or working fluid filling the heating chamber. The other feature of the present invention is that a protection layer is not required on the surface of the heating unit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
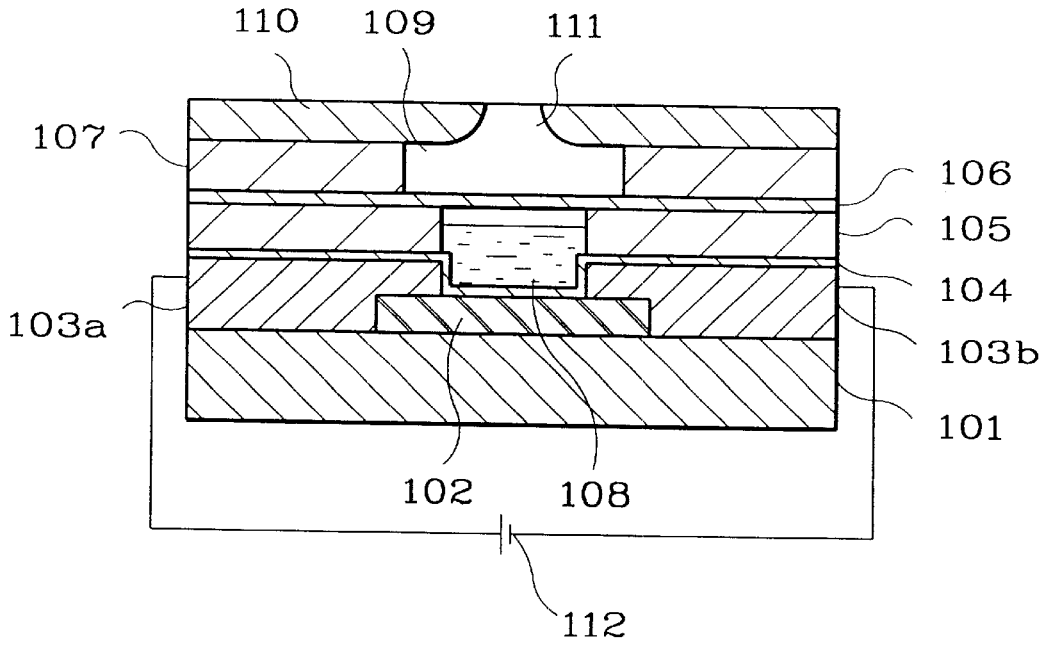
FIG. 1 is a vertical cross-sectional view of an earlier spraying device of an ink jet printer.

Turning now to the drawings, the earlier ink jet spraying device containing a membrane is shown in FIG. 1. Heating unit 102 performing heating is formed on a surface of substrate layer 101 by electric energy. Electrodes of different polarity 103*a,* 103*b* which input power offered from power unit 112 and offer the electric energy to heating unit 102 are formed on the surfaces of substrate 101 and heating unit 102. Protection layer 104 is formed on surfaces of electrodes 103*a,* 103*b* and heating unit 102. Insulation layer 105 is formed with a regular interval on some locations pertinent to the surface of electrodes 103*a,* 103*b* on protection layer 104. And membrane layer 106 is formed on a surface of insulation layer 105. The spaces formed by protection layer 104, electrodes 103*a,* 103*b,* insulation layer 105 and membrane layer 106 are called heating chamber 108. Ink is stored in an ink chamber 109 formed by ink chamber barrier 107 on a surface of membrane layer 106. And a nozzle plate having an opening is formed on a surface of ink chamber barrier 107. And a liquid actuator or working fluid which is a liquid with a low boiling point is stored in the heating chamber.

Thus, in this device, heating chamber 108 is configured by forming protection layer 104 on heating unit 102. The energy transmitted to a liquid actuator within heating chamber 108 is transmitted in inverse proportion to the thickness of protection layer 104. Accordingly, it is necessary to drive the device with high energy and low frequency, with a result of high power consumption and low speed printing.

Figure 2:
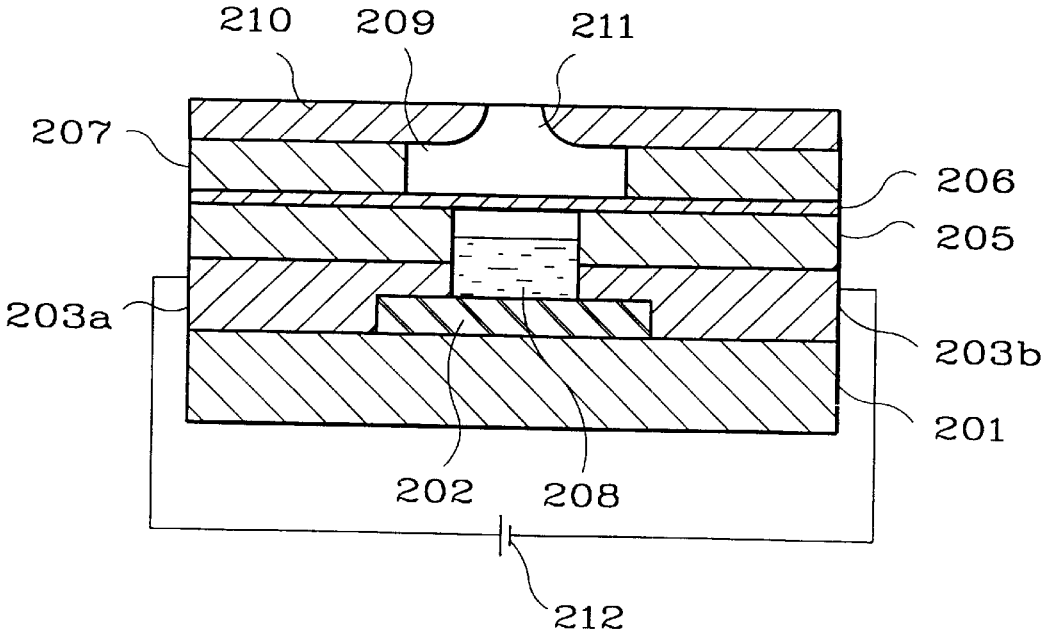
FIG. 2 is a vertical cross-sectional view of spraying device of an ink jet printer according to the present invention.

Hereinafter, a preferred embodiment of the present invention will be described with reference to the attached drawings as follows. FIG. 2 illustrates the configuration of the spraying device of ink jet printer according to the present invention. The device of FIG. 2 comprises heating unit 202 formed on a surface of substrate 201; plural electrodes 203*a,* 203*b* formed on the surfaces of substrate 201 and heating unit 202 with a regular distance and offering electric energy to heating unit 202; a power source for supplying electric energy with different polarity to electrodes 203*a,* 203*b;* insulation layer 205 formed on a surface of the plural electrodes 203*a,* 203*b* with a regular distance; membrane layer 206 formed on a surface of insulation layer 205 and causing a volume change by thermal expansion; ink chamber barrier 207 located on a surface of membrane layer 206 and forming a insertion path for ink; and nozzle plate 210 located on a surface of ink chamber barrier 207 and having plural openings 211.

An important point about the present invention is that no protection layer is formed between electrodes 203*a,* 203*b* and insulation layer 205 and between heating unit 202 and the working fluid, unlike the described earlier inkjet device. Thus a liquid actuator within heating chamber 208 is in contact with the heating unit 202 and electrodes 203*a* and 203*b*.

Heating unit 202 consists of TaAl or $TiB_2$. An isomer of heptane ($C_7H_{16}$) or perfluoroheptane ($C_7F_{16}$) is used as a working fluid located inside heating chamber 208. In particular, n-heptane or n-perfluoroheptane may be used. Both of these substances share the property of being non-corrosive and non-reactive to alloys consisting of Cu, Al, Ni, Zn, Ti, N, etc. used as electrodes 203*a* and 203*b* and being noncorrosive to TaAl or $TiB_2$ that make up heating unit 202. Also, these substances share the features that they are not inflammable, explosive or poisonous.

A liquid actuator is in direct contact with heating unit 202 which consists of TaAl or $TiB_2$ as well as electrodes 203*a* and 203*b* which may be made of Cu, Al, Ni, Zn, Ti and N. Ink in the ink chamber is sprayed by changing the volume of the membrane through the expansion due to heating. And very rapid production of vapor pressure is produced since a liquid actuator contacts directly with the heating unit and readily transmits the heat. Thus high speed printing becomes possible by using low energy.

As described above, the present invention requires a protection layer to protect the heating unit. And vapor pressure is produced in a short time by means that liquid actuator contacts directly with the heating unit and transmits the heat. And high speed printing becomes possible by using low energy. Also, a production process in order to produce the protection layer is not required, so the production costs are saved.

What is claimed is:

1. A spraying unit of an ink jet printer, comprising:

a substrate;

a resistance heating unit formed on said substrate;

electrodes connected to said resistance heating unit to provide electric energy to the resistance heating unit, where said resistance heating unit defines the bottom of a heating chamber and said electrodes define a portion of a wall of the heating chamber;

an insulation layer formed on said electrodes, said insulation layer defining a further portion of said wall of the heating chamber;

a membrane layer formed on said insulation layer so as to form a membrane which fully spans said heating chamber and so as to enclose said heating chamber;

a liquid actuator in said heating chamber, said liquid actuator therefore being in direct contact with said resistance heating unit;

an ink chamber barrier formed on said membrane, defining an ink chamber above said heating chamber; and a nozzle formed on said ink chamber barrier.

2. The spraying device of claim 1, where said liquid actuator comprises an isomer of heptane.

3. The spraying device of claim 2, where said heater resistor unit consists essentially either of $TiB_2$ or of TaAl.

4. The spraying device of claim 2, where said liquid actuator consists essentially of n-heptane.

5. The spraying device of claim 4, where said heater resistor unit consists essentially either of $TiB_2$ or of TaAl.

6. The spraying device of claim 1, where said liquid actuator comprises an isomer of perfluoroheptane.

7. The spraying device of claim 6, where said heater resistor unit consists essentially either of $TiB_2$ or of TaAl.

8. The spraying device of claim, 6, where said liquid actuator consists essentially of n-perfluoroheptane.

9. The spraying device of claim 8, where said heater resistor unit consists essentially either of $TiB_2$ or of TaAl.

10. The spraying device of claim 1, where said heater resistor unit consists essentially either of $TiB_2$ or of TaAl.

11. A spraying unit of an ink jet printer, comprising:

a substrate;

a resistance heating unit formed on said substrate, said heating resistance unit consists essentially either of $TiB_2$ or of TaAl;

electrodes connected to said resistance heating unit to provide electric energy to the resistance heating unit, where said resistance heating unit defines the bottom of a heating chamber and said electrodes define a portion of a wall of the heating chamber;

an insulation layer formed on said electrodes, said insulation layer defining a further portion of said wall of the heating chamber;

a membrane layer formed on said insulation layer so as to form a membrane which fully spans said heating chamber and so as to enclose said heating chamber;

a liquid actuator in said heating chamber positioned in direct contact with said resistance heating unit;

an ink chamber barrier formed on said membrane, defining an ink chamber above said heating chamber; and a nozzle formed on said ink chamber barrier.

12. The spraying device of claim 11, where said liquid actuator comprises an isomer of heptane.

13. The spraying device of claim 11, where said liquid actuator comprises an isomer of perfluoroheptane.

14. The spraying device of claim 11, where said liquid actuator consists essentially of n-heptane.

15. The spraying device of claim 11, where said liquid actuator consists essentially of n-perfluoroheptane.

16. A spraying unit of an ink jet printer, comprising:

a substrate;

a resistance heating unit formed on said substrate;

electrodes connected to said resistance heating unit to provide electric energy to the resistance heating unit, where said resistance heating unit defines the bottom of a heating chamber and said electrodes define a portion of a wall of the heating chamber;

an insulation layer formed on said electrodes, said insulation layer defining a further portion of said wall of the heating chamber;

a membrane layer formed on said insulation layer so as to form a membrane which fully spans said heating chamber and so as to enclose said heating chamber;

a liquid actuator in said heating chamber positioned in direct contact with said resistance heating unit, said liquid actuator comprises an isomer of heptane;

an ink chamber barrier formed on said membrane, defining an ink chamber above said heating chamber; and a nozzle formed on said ink chamber barrier.

17. The spraying device of claim 16, where said heater resistor unit consists essentially either of $TiB_2$ or of TaAl.

18. The spraying device of claim 16, where said liquid actuator consists essentially of n-heptane.

19. An ink jet printer, comprising:

a substrate;

a resistance heating unit formed on said substrate;

a pair of electrodes connected to said resistance heating unit, where said resistance heating unit defines the bottom of a heating chamber and said each one of said pair of electrodes define a portion of a sidewall of said heating chamber;

an insulation layer formed on top of said pair of electrodes, said insulation layer defining a further portion of said sidewall of said heating chamber;

a membrane layer formed on said insulation layer so as to enclose said heating chamber;

a working fluid disposed in said heating chamber, said working fluid being in direct contact with said resistance heating unit and in direct contact with portions of each one of said pair of electrodes;

an ink chamber barrier formed on said membrane, defining an ink chamber above said heating chamber; and a nozzle formed on said ink chamber barrier.

20. The ink jet printer of claim 19, where said working fluid comprises an isomer of heptane.

21. The ink jet printer of claim 19, where said working fluid comprises an isomer of perfluoroheptane.

22. The inkjet printer of claim 19, wherein said resistance heating unit comprises either $TiB_2$ or TaAl.

23. The ink jet printer of claim 19, wherein said pair of electrodes comprise either Cu, Al, Ni, Zn, Ti, or N.

* * * * *